US011515071B2

(12) United States Patent
Hashimoto

(10) Patent No.: US 11,515,071 B2
(45) Date of Patent: Nov. 29, 2022

(54) DRUM CORE AND WIRE COIL COMPONENT

(71) Applicant: Murata Manufacturing Co., Ltd., Kyoto-fu (JP)

(72) Inventor: Ryota Hashimoto, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 550 days.

(21) Appl. No.: 16/525,296

(22) Filed: Jul. 29, 2019

(65) Prior Publication Data

US 2020/0051730 A1 Feb. 13, 2020

(30) Foreign Application Priority Data

Aug. 9, 2018 (JP) ..... JP2018-150390

(51) Int. Cl.
*H01F 27/24* (2006.01)
*H01F 27/29* (2006.01)
*H01F 27/28* (2006.01)

(52) U.S. Cl.
CPC ..... *H01F 27/24* (2013.01); *H01F 27/2823* (2013.01); *H01F 27/29* (2013.01)

(58) Field of Classification Search
CPC ..... H01F 27/24; H01F 27/2823; H01F 27/29; H01F 3/10; H01F 27/2828; H01F 2017/0093; H01F 17/045; H01F 17/04; H01F 27/292
See application file for complete search history.

(56) References Cited

U.S. PATENT DOCUMENTS 5,963,119 A * 10/1999 Takeda ..... H01F 17/045 336/200
6,242,996 B1 * 6/2001 Sato ..... H01F 17/045 336/200
2005/0052267 A1 * 3/2005 Singu ..... H01F 27/292 336/83
2006/0071749 A1 * 4/2006 Aoki ..... H01F 17/045 336/83
2008/0003864 A1 * 1/2008 Hatakeyama ..... H01F 17/045 439/399
2012/0133469 A1 * 5/2012 Tomonari ..... H01F 27/292 336/192

(Continued)

FOREIGN PATENT DOCUMENTS

JP 2000-208331 A 7/2000

*Primary Examiner* — Mang Tin Bik Lian
(74) *Attorney, Agent, or Firm* — Studebaker & Brackett PC

(57) ABSTRACT

A drum core includes a core portion that extends in an axial direction, first and second flange portions respectively disposed at first and second ends of the core portion in the axial direction, and first and second terminal electrodes respectively disposed at the first and second flange portions. The first flange portion includes a bottom surface that is substantially parallel to the axial direction and on which the first terminal electrode is disposed, an outer end surface that is substantially perpendicular to the axial direction and that faces outward away from the core portion, and a first ridge portion and a second ridge portion respectively disposed at a first end and a second end of the outer end surface in a width direction substantially parallel to the bottom surface and the outer end surface, and the first ridge portion and the second ridge portion have different shapes.

20 Claims, 4 Drawing Sheets

(56) References Cited

U.S. PATENT DOCUMENTS

| | | | | |
|---|---|---|---|---|
| 2017/0229230 | A1* | 8/2017 | Kawasaki | H01F 27/2828 |
| 2018/0130597 | A1* | 5/2018 | Komaya | H01F 17/045 |
| 2018/0286554 | A1* | 10/2018 | Kojima | H01F 27/29 |
| 2018/0342346 | A1* | 11/2018 | Hashimoto | H01F 27/24 |

* cited by examiner

DRUM CORE AND WIRE COIL COMPONENT

CROSS-REFERENCE TO RELATED APPLICATION

This application claims benefit of priority to Japanese Patent Application No. 2018-150390, filed Aug. 9, 2018, the entire content of which is incorporated herein by reference.

BACKGROUND

Technical Field

The present disclosure relates to a drum core used for a wire coil component including a wire wound around a core portion.

Background Art

A wire coil component disclosed in Japanese Unexamined Patent Application Publication No. 2000-208331 includes a drum core and a wire. The drum core includes a core portion, extending in an axial direction, flange portions, disposed on both ends of the core portion, and terminal electrodes, disposed at the flange portions. The wire is wound around the core portion. The flange portions each have a bottom surface, which is parallel to the axial direction and on which the terminal electrodes are disposed, an outer end surface, which is perpendicular to the axial direction and faces outward away from the core portion, and two side surfaces, which are parallel to the axial direction and perpendicular to the bottom surface to face each other.

In the wire coil component disclosed in Japanese Unexamined Patent Application Publication No. 2000-208331, the two side surfaces normally have the same shape. Particularly, two ridge portions connecting the two side surfaces and the outer end surface together have the same shape.

SUMMARY

As described in Japanese Unexamined Patent Application Publication No. 2000-208331, the two side surfaces have the same shape and the two ridge portions have the same shape mainly for the sake of convenience of manufacturing a drum core. Specifically, a drum core includes terminal electrodes on the bottom surfaces of the flange portions. Here, if the two side surfaces have the same shape and the two ridge portions have the same shape, drum cores with the same shape can be manufactured while having either the upper surface or lower surface of each flange portion defined as a bottom surface (on which the terminal electrode is disposed). Specifically, drum cores with the side surfaces and the ridge portions as those described in Japanese Unexamined Patent Application Publication No. 2000-208331 are efficiently manufactured without involving alignment of the drum cores in a specific direction during formation of the terminal electrodes.

The inventor of the present application has found that a drum core including two ridge portions with the same shape, such as that in Japanese Unexamined Patent Application Publication No. 2000-208331, has the following problem.

In a step of manufacturing a wire coil component, at least one wire is wound around a core portion of a drum core with a winding machine, and ends of the wire are electrically connected to the terminal electrodes. In a step of winding the wire, the drum core is rotated to wind the wire around a core portion 35 while a first flange portion 33 is held between jigs 31 and 32 of the winding machine, as illustrated in FIG. 6. Here, for convenience of holding the first flange portion 33, the winding machine usually includes jigs with different shapes, such as the jigs 31 and 32. Specifically, the jig 31 has an letter L shape to come in contact with the first flange portion 33 over two surfaces, that is, a first side surface 33*a* and an outer end surface 33*c*, to fix the position of the first flange portion 33. The jig 32 has a straight shape to come into contact with the first flange portion 33 over only one surface, that is a second side surface 33*b*, to apply a holding force to the first flange portion 33.

In consideration of a force exerted on a drum core while winding a wire around the core portion 35 or connecting the wire to the terminal electrodes, the jigs 31 and 32 preferably exert a large holding force on the first flange portion 33. Preferably, a drum core has such a shape as to be held by the jigs 31 and 32 with an enhanced holding force, specifically, such a shape as to be in contact with the jigs 31 and 32 over a larger contact area. A conceivable example to increase the dimension of the second side surface 33*b* in the axial direction A over which it is in contact with the jig 32 is to reduce the dimension of a second ridge portion 33*e*, which connects the second side surface 33*b* and the outer end surface 33*c* together, in the axial direction A.

Here, in the existing drum core in which the first side surface 33*a* and the second side surface 33*b* have the same shape, the dimension of a first ridge portion 33*d*, which connects the first side surface 33*a* and the outer end surface 33*c* together, in the axial direction A is also reduced. In this case, besides the contact area between the drum core and the jig 32, the contact area between the drum core and the jig 31 is also increased. The inventor of the present application has found that increasing the contact area between the drum core and the jigs 31 and 32 not only increases the holding force but also increases the risk of breaking or cracking of the drum core. The inventor has also found that the components, such as the jigs 31 and 32, having different shapes have different correlations between the holding force exerted on the contact area and the breaking/cracking risk on the contact area.

The present disclosure is based on the above findings, and provides a drum core that has a smaller risk of breaking/cracking while bearing a holding force to have a wire wound therearound, and a wire coil component including the drum core.

A drum core according to an aspect of the present disclosure includes a core portion that extends in an axial direction; a first flange portion and a second flange portion respectively disposed at a first end and a second end of the core portion in the axial direction; and a first terminal electrode and a second terminal electrode respectively disposed at the first flange portion and the second flange portion. The first flange portion includes a bottom surface that is substantially parallel to the axial direction and on which the first terminal electrode is disposed, an outer end surface that is substantially perpendicular to the axial direction and that faces outward away from the core portion, and a first ridge portion and a second ridge portion respectively disposed at a first end and a second end of the outer end surface in a width direction substantially parallel to the bottom surface and the outer end surface. The first ridge portion and the second ridge portion have different shapes.

A drum core with this structure has a smaller breaking/cracking risk while bearing a holding force to have a wire wound therearound.

In the above drum core, the first ridge portion may have a larger dimension in the axial direction than the second ridge portion. A drum core with this structure has a smaller breaking/cracking risk while bearing a holding force to have a wire wound therearound.

In the above drum core, the first ridge portion and the second ridge portion may have curved shapes. The first ridge portion may have a radius of curvature larger than a radius of curvature of the second ridge portion. A drum core with this structure has a smaller breaking/cracking risk while bearing a holding force to have a wire wound therearound.

In the above drum core, the first flange portion may further include an inner end surface that is substantially perpendicular to the axial direction and faces the core portion, and a third ridge portion disposed at a first end of the inner end surface, on the same side as the first end of the outer end surface. The third ridge portion may have a smaller dimension in the axial direction than the first ridge portion. A drum core with this structure can bear a larger holding force without having a breaking/cracking risk largely affected.

In the above drum core, the first ridge portion and the third ridge portion may have curved shapes. The third ridge portion may have a radius of curvature smaller than a radius of curvature of the first ridge portion. A drum core with this structure can bear a larger holding force without having a breaking/cracking risk largely affected.

In the above drum core, the first flange portion may further include an inner end surface that is substantially perpendicular to the axial direction and faces the core portion, and a third ridge portion and a fourth ridge portion respectively disposed at a first end and a second end of the inner end surface, the first end and the second end of the inner end surface are respectively on the same side as the first end and the second end of the outer end surface. Each of the third ridge portion and the fourth ridge portion may has a smaller dimension in the axial direction than both of the first ridge portion and the second ridge portion. A drum core with this structure can bear a larger holding force without having a breaking/cracking risk largely affected.

In the above drum core, the first ridge portion, the second ridge portion, the third ridge portion, and the fourth ridge portion may have curved shapes. Each of the third ridge portion and the fourth ridge portion may has a radius of curvature smaller than both of a radius of curvature of the first ridge portion and a radius of curvature of the second ridge portion. A drum core with this structure can bear a larger holding force without having a breaking/cracking risk largely affected.

In the above drum core, the first ridge portion may have a planar shape. In this structure, the first ridge portions having a planar shape can be formed by being subjected to post processing such as cutting or grinding after forming of a drum core. Thus, the first ridge portions can be more easily formed.

In the above drum core, the first ridge portion may include, in combination, a curved shape continuous with a first end of the outer end surface and a planar shape continuous with the curved shape. This structure also has a smaller breaking/cracking risk while bearing a holding force to have a wire wound therearound.

In the above drum core, when viewed in a direction substantially orthogonal to the bottom surface, the first flange portion and the second flange portion may be centrally symmetric with respect to a center of the core portion.

The drum core having the above structure does not limit the flange portion that is to be held to either one of the first flange portion and the second flange portion to have wires wound therearound, thereby improving manufacturing efficiency.

In the above drum core, the first flange portion may have a dimension in the axial direction of smaller than or equal to about 0.35 mm. The wire coil component with this structure more effectively exerts the above effect.

A wire coil component according to an aspect of the disclosure includes the drum core according to any one of the above aspects; and a plurality of wires wound around the core portion of the drum core. The wire coil component with this structure more effectively exerts the above effect and has a stable quality.

The drum core according to an aspect of the disclosure has a smaller breaking/cracking risk while bearing a holding force to have a wire wound therearound. The wire coil component according to an aspect of the disclosure more effectively exerts the above effect and has a stable quality.

Other features, elements, characteristics and advantages of the present disclosure will become more apparent from the following detailed description of embodiments of the present disclosure with reference to the attached drawings.

DETAILED DESCRIPTION

Embodiments, which are aspects of the present disclosure, are described below with reference to the drawings.

First Embodiment

Figure 1:
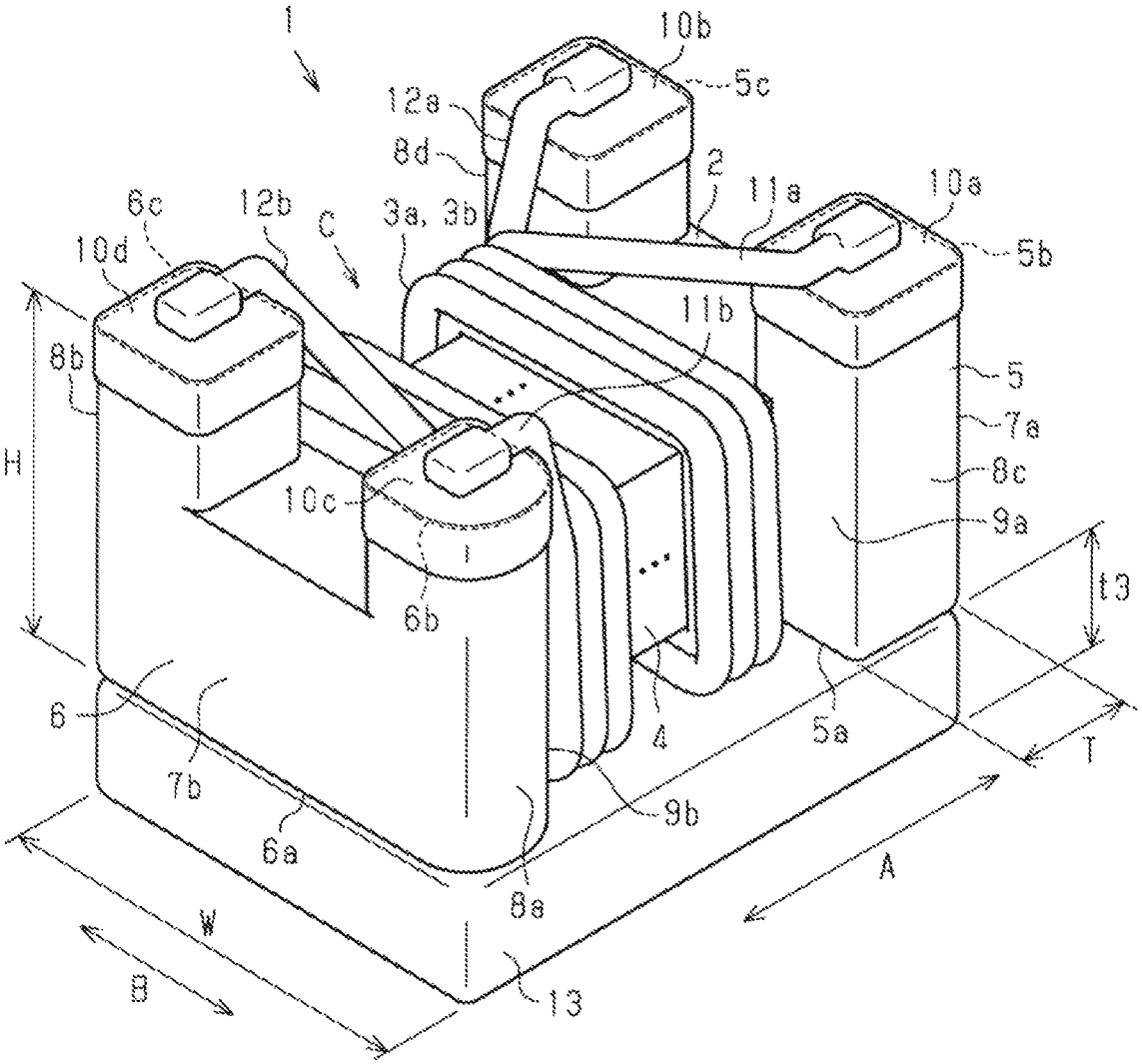
FIG. 1 is a perspective view of a wire coil component.

A wire coil component 1 illustrated in FIG. 1 includes a drum core 2, and two wires 3*a* and 3*b*, wound around a core portion 4 of the drum core 2. The wire coil component 1 is, for example, a common-mode choke coil.

The drum core 2 is formed from, for example, an electrical insulating material, specifically, a non-magnetic material such as alumina or resin, or a magnetic material such as ferrite or resin containing magnetic powder. Preferably, the drum core 2 is formed from a sintered body such as alumina or ferrite.

The drum core 2 includes a core portion 4, having a quadrangular prism shape extending in the axial direction (direction of arrow A in FIG. 1), a first flange portion 5 and a second flange portion 6, respectively disposed at a first end and a second end of the core portion 4 in the axial direction, first terminal electrodes 10*a* and 10*b* and second terminal electrodes 10*c* and 10*d*, respectively disposed at the first flange portion 5 and the second flange portion 6. The core portion 4, the first flange portion 5, and the second flange portion 6 are integrated together.

The first and second flange portions 5 and 6 have a width W and a height H larger than the width and the height of the core portion 4, and a thickness T smaller than the length of the core portion 4. The first and second flange portions 5 and 6 project from the core portion 4 into a flange shape. In the above description, the length of the core portion 4 and the thickness T of the first and second flange portions 5 and 6 correspond to the dimensions in the axial direction. The height corresponds to the dimension in the direction substantially perpendicular to a mount surface defined by the first terminal electrodes 10*a* and 10*b* and the second terminal electrodes 10*c* and 10*d*. The width corresponds to the dimension in the direction substantially perpendicular to both the length and the height. The thickness T is, for example, smaller than or equal to about 0.35 mm. The directions substantially parallel to the height and the width are respectively referred to as a height direction and a width direction (direction of arrow B in FIG. 1).

The first flange portion 5 has bottom surfaces 5*b* and 5*c*, which are substantially parallel to the axial direction of the core portion 4 and on which the first terminal electrodes 10*a* and 10*b* are disposed, an outer end surface 7*a*, which is substantially perpendicular to the axial direction and faces outward away from the core portion 4, and a third side surface 8*c* and a fourth side surface 8*d*, which are disposed on both sides of the outer end surface 7*a* in the width direction B and are substantially perpendicular to the outer end surface 7*a* and substantially parallel to the axial direction. The first flange portion 5 also has inner end surface 9*a*, which is substantially perpendicular to the axial direction and faces inward toward the core portion 4.

Similarly, the second flange portion 6 has bottom surfaces 6*b* and 6*c*, which are substantially parallel to the axial direction of the core portion 4 and on which the second terminal electrodes 10*c* and 10*d* are disposed, an outer end surface 7*b*, which is substantially perpendicular to the axial direction and faces outward away from the core portion 4, and a first side surface 8*a* and a second side surface 8*b*, which are disposed on both sides of the outer end surface 7*b* in the width direction B and which are substantially perpendicular to the outer end surface 7*b* and substantially parallel to the axial direction. The second flange portion 6 also has inner end surface 9*b*, which is substantially perpendicular to the axial direction and faces inward toward the core portion 4. As is clear from the above structure, the width direction B is substantially parallel to the bottom surfaces 5*b*, 5*c*, 6*b*, and 6*c* and the outer end surfaces 7*a* and 7*b*.

The first terminal electrodes 10*a* and 10*b* and the second terminal electrodes 10*c* and 10*d* are disposed on the bottom surfaces 5*c*, 5*c*, 6*b*, and 6*c* of protruding steps extending in the height direction from the lower portions of the first and second flange portions 5 and 6. The first terminal electrodes 10*a* and 10*b* and the second terminal electrodes 10*c* and 10*d* are formed by baking electroconductive paste containing, for example, silver as an electroconductive component, and, as needed, plated with Ni, Cu, Sn, or other metal. Instead, the first terminal electrodes 10*a* and 10*b* and the second terminal electrodes 10*c* and 10*d* may be terminal metal fittings bonded to the first and second flange portions 5 and 6 and formed from electroconductive metal plates covering the bottom surfaces 5*b*, 5*c*, 6*b*, and 6*c*.

The wires 3*a* and 3*b* are formed from, for example, an insulating coating formed from resin such as polyurethane or polyimide, and a copper wire coated with the insulating coating. The wires 3*a* and 3*b* are helically wound around the core portion 4 in two layers to form a coil C. The wire 3*a* has a first end 11*a* connected to the terminal electrode 10*a*, and a second end 11*b* connected to the terminal electrode 10*c*. The wire 3*b* has a first end 12*a* connected to the terminal electrode 10*b*, and a second end 12*b* connected to the terminal electrode 10*d*. The first terminal electrodes 10*a* and 10*b* and the second terminal electrodes 10*c* and 10*d* are connected to the wires 3*a* and 3*b* by, for example, thermo-compression bonding or laser welding.

A flat core 13 is a plate-shaped member bonded to top surfaces 5*a* and 6*a* (undersurfaces in FIG. 1), opposite to the bottom surfaces 5*b*, 5*c*, 6*b*, and 6*c* of the first and second flange portions 5 and 6 of the drum core 2 with a bonding agent. The flat core 13 is formed from a material the same as that of the drum core 2, and has a height t3, which is lower than or equal to ⅓ of the height of the wire coil component 1 including the flat core 13. Preferably, the flat core 13 may be formed from the same material as the drum core 2 to form a stable, closed magnetic circuit. Alternatively, the flat core 13 may be formed from resin to have a small thickness regardless of the material of the drum core 2.

The shapes of the first and second flange portions 5 and 6 are described, below.

Figure 2:
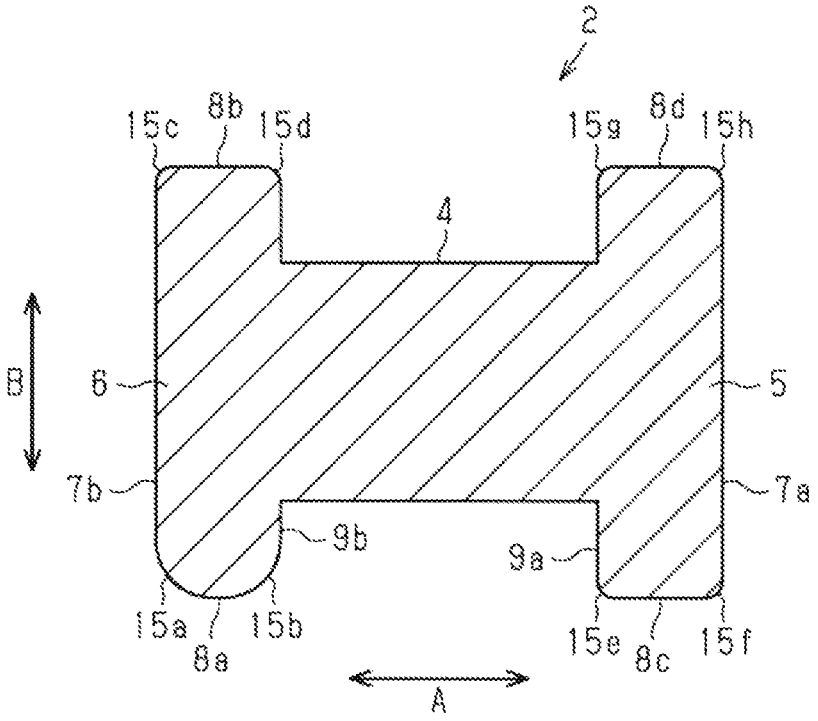
FIG. 2 is a cross-sectional view of a drum core according to a first embodiment.

As illustrated in FIG. 2, the first flange portion 5 includes a first ridge portion 15*h* and a second ridge portion 15*f*, respectively disposed at the first end and the second end of the outer end surface 7*a* in the width direction B, and a third ridge portion 15*g* and a fourth ridge portion 15*e*, respectively disposed at the first end and the second end of the inner end surface 9*a* in the width direction B. In the above description, the first ends are closer to the fourth side surface 8*d*, and the second ends are closer to the third side surface 8*c*. In the first flange portion 5, the inner end surface 9*a*, the third ridge portion 15*g*, the fourth side surface 8*d*, the first ridge portion 15*h*, the outer end surface 7*a*, the second ridge portion 15*f*, the third side surface 8*c*, the fourth ridge portion 15*e*, and the inner end surface 9*a* are continuous in this order.

Similarly, the second flange portion 6 includes a first ridge portion 15*a* and a second ridge portion 15*c*, respectively disposed at the first end and the second end of the outer end surface 7*b* in the width direction B, and a third ridge portion 15*b* and a fourth ridge portion 15*d*, disposed at the first end and the second end of the inner end surface 9*b* in the width direction B. In the above description, the first ends are closer to the first side surface 8*a*, and the second ends are closer to the second side surface 8*b*. The first ends and the second ends are in the positions opposite to those in the first flange portion 5. In the second flange portion 6, the inner end surface 9*b*, the third ridge portion 15*b*, the first side surface 8*a*, the first ridge portion 15*a*, the outer end surface 7*b*, the second ridge portion 15*c*, the second side surface 8*b*, the fourth ridge portion 15*d*, and the inner end surface 9*b* are continuous in this order.

The ridge portions 15*a* to 15*h* have curved shapes. In the second flange portion 6, the first ridge portion 15*a* and the second ridge portion 15*c* have different shapes. Specifically, the first ridge portion 15*a* and the second ridge portion 15*c* have curved shapes, and the first ridge portion 15*a* has a radius of curvature larger than the radius of curvature of the second ridge portion 15*c*. Thus, the first ridge portion 15*a* has a dimension in the axial direction longer than the second ridge portion 15*c*, and the first side surface 8*a* and the second side surface 8*b* are asymmetric with respect to each other.

Now, the effect of the drum core 2 with the above structure is described.

Figure 6:
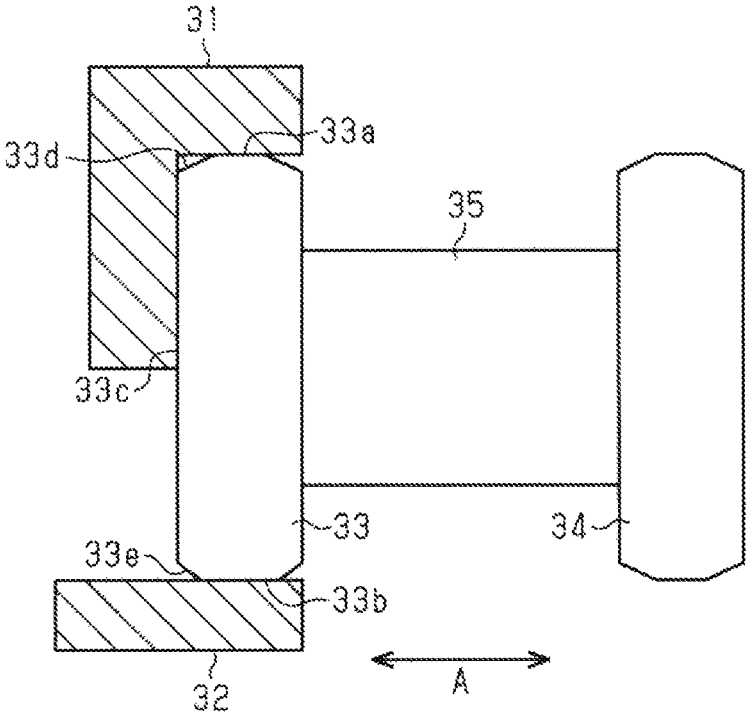
FIG. 6 is a side view of a drum core held by jigs.

When a winding machine including jigs having different shapes, as in the jigs 31 and 32 in FIG. 6, is to hold the drum core 2, the drum core 2 has a smaller breaking/cracking risk while bearing a holding force to have a wire wound therearound. Specifically, to hold the second flange portion 6 of the drum core 2 with jigs, the first ridge portion 15*a* and the second ridge portion 15*c*, which have different shapes, may be in contact with one of the jigs over a larger contact area, and in contact with the other jig over a smaller contact area.

Specifically, the radius of curvature of the first ridge portion 15*a* is larger than the radius of curvature of the second ridge portion 15*c*, and the first ridge portion 15*a* has a larger dimension in the axial direction than the second ridge portion 15*c*. Thus, the first ridge portion 15*a* is in contact with the corresponding jig over a small contact area, and the second ridge portion 15*c* is in contact with the corresponding jig over a large contact area.

The inventor of the present application has found that jigs with different shapes have different correlations between the holding force exerted on the contact area and the breaking/cracking risk on the contact area. Specifically, for example, in the jigs 31 and 32 illustrated in FIG. 6, the inventor of the present application has found that the jig 31 has a smaller constant of proportionality of the breaking/cracking risk on the contact area relative to the constant of proportionality of the holding force exerted on the contact area, and the jig 32 has a larger constant of proportionality of the breaking/cracking risk on the contact area relative to the constant of proportionality of the holding force exerted on the contact area.

Thus, in this case, the second ridge portion 15*c* that comes into contact with the jig 31 over a larger contact area is in contact with the jig 31, and the first ridge portion 15*a* that comes into contact with the jig 32 over a smaller contact area is in contact with the jig 32. Here, when the drum core 2 is held by a winding machine, the drum core 2 can bear a larger holding force while having the breaking/cracking risk reduced to a relatively low level. Specifically, the drum core 2 has a smaller breaking/cracking risk while bearing a larger holding force to have a wire wound therearound.

The second flange portion 6 of the drum core 2 has a dimension substantially parallel to the axial direction (thickness T) of the first and second flange portions 5 and 6 of smaller than or equal to about 0.35 mm. Here, the first and second flange portions 5 and 6 are thin, and has low absolute strength. As described above, the drum core 2 more effectively reduces the breaking/cracking risk.

The wire coil component 1 includes the drum core 2 and multiple, specifically, two wires 3*a* and 3*b* wound around the core portion 4 of the drum core 2. As the number of wires wound around the core portion 4 increases, the stress exerted on the drum core 2 increases, and the demand for the increase of the holding force or the reduction of the breaking/cracking risk increases. Thus, the wire coil component 1 including the two wires 3*a* and 3*b* more effectively exerts the above effect and has a stable quality.

In the wiring step, the flange portion of the drum core 2 that is to be held is selectable. Thus, the first and second flange portions 5 and 6, which are designated for convenience sake, may be switched. Specifically, for example, the flange portion 5 may be a second flange portion and the flange portion 6 may be a first flange portion.

Second Embodiment

Figure 3:
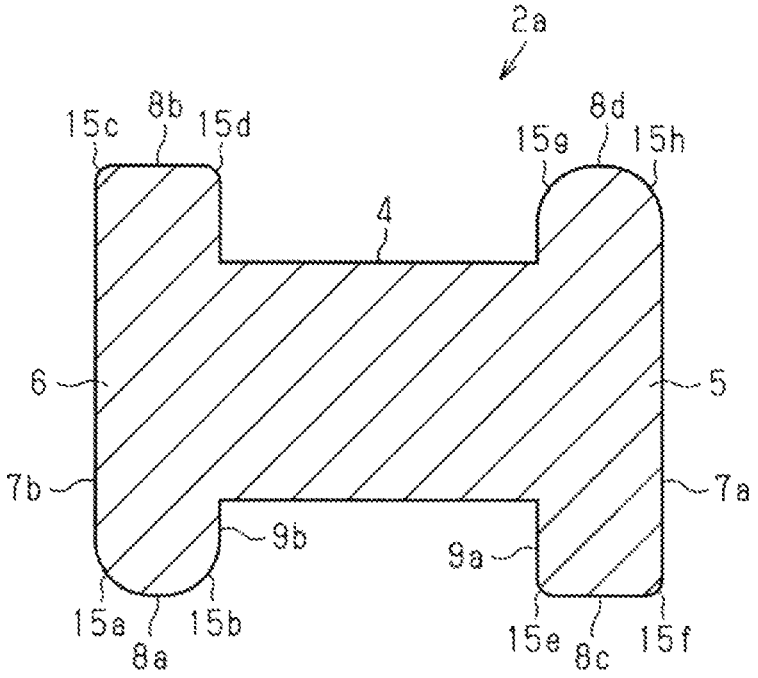
FIG. 3 is a cross-sectional view of a drum core according to a second embodiment.

FIG. 3 illustrates a second embodiment. A drum core 2*a* according to this embodiment includes a first flange portion 5, which includes a first ridge portion 15*h* and a third ridge portion 15*g*, disposed at the first ends of the outer end surface 7*a* and the inner end surface 9*a* in the width direction B. The first ridge portion 15*h* and the third ridge portion 15*g* respectively have the same shapes as the first ridge portion 15*a* and the third ridge portion 15*b* of the second flange portion. Thus, the third side surface 8*c* and the fourth side surface 8*d* are asymmetric with respect to each other. Other components are the same as those of the first embodiment.

Thus, as shown in FIG. 3, when viewed in the direction substantially orthogonal to the bottom surfaces 5*b*, 5*c*, 6*b*, and 6*c*, the first flange portion 5 and the second flange portion 6 are centrally symmetric with respect to the center of the core portion 4.

The drum core 2*a* having the above structure does not limit the flange portion that is to be held to either one of the first flange portion 5 and the second flange portion 6 to have wires 3*a* and 3*b* wound therearound, thereby improving manufacturing efficiency.

The above drum core 2*a* has the following effects besides the effects obtained in the first embodiment.

(1) The drum core 2*a* has substantially no difference between the bottom surface and the top surface. Thus, for example, this structure does not require an operator to select from the near side and the far side of FIG. 3 on which the terminal electrodes 10*a* to 10*d* are to be disposed and on which the flat core 13 is to be bonded. Thus, besides the step of winding the wires 3*a* and 3*b* around the drum core 2*a*, the step of forming the terminal electrodes 10*a* to 10*d* is also performed with improved efficiency.

Third Embodiment

Figure 4A:
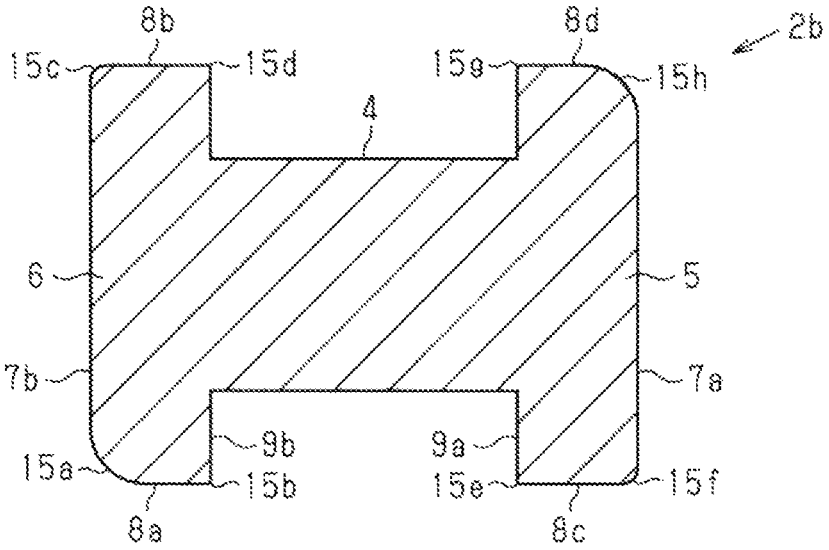
FIGS. 4A to 4C are cross-sectional views of a drum core according to a third embodiment.
Figure 4B:
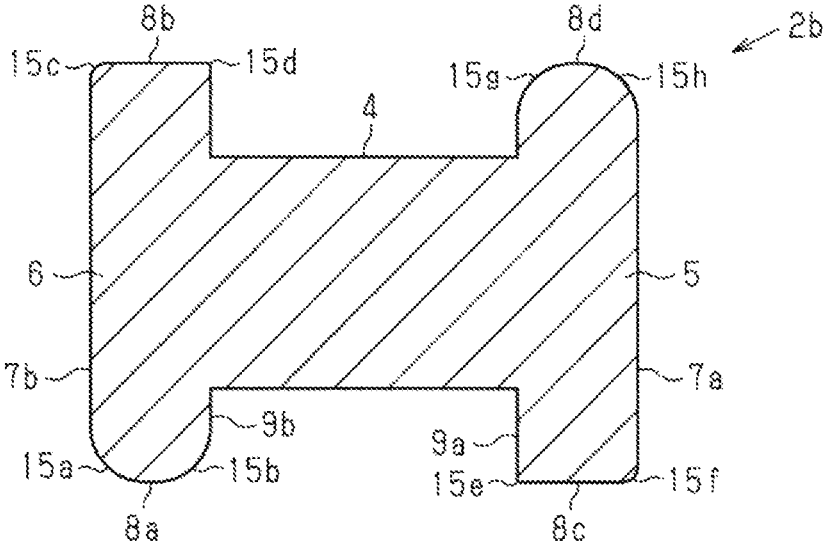
Figure 4C:
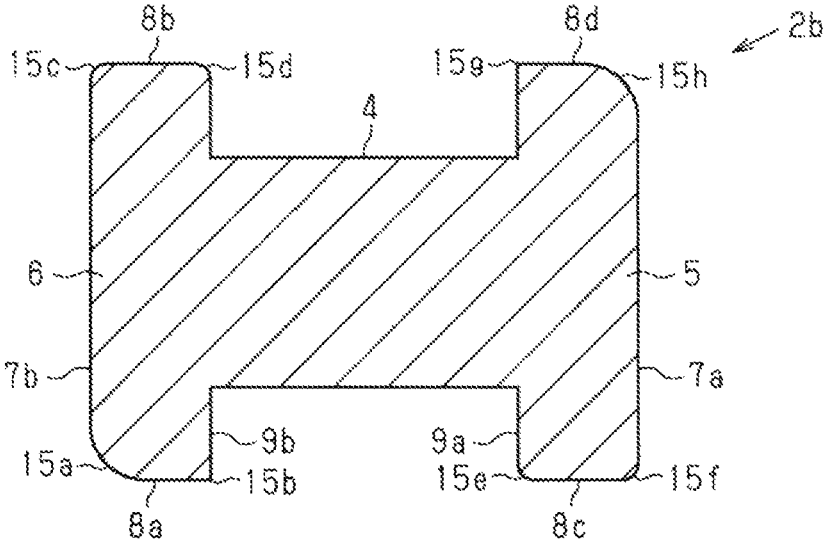

FIGS. 4A to 4C illustrate a third embodiment. In a drum core 2*b* according to this embodiment, the third ridge portions 15*g* and 15*b* and the fourth ridge portions 15*e* and 15*d* disposed on the inner end surfaces 9*a* and 9*b* of the first and second flange portions 5 and 6 have shapes changed from those of the other embodiment.

Compared to the first ridge portions 15*h* and 15*a* and the second ridge portions 15*f* and 15*c* disposed closer to the outer end surfaces 7*a* and 7*b*, the third ridge portions 15*g* and 15*b* and the fourth ridge portions 15*e* and 15*d* disposed closer to the inner end surfaces 9*a* and 9*b* are affected to a lesser extent by the difference of jig shapes. The third ridge portions 15*g* and 15*b* and the fourth ridge portions 15*e* and 15*d* both have a small constant of proportionality of the breaking/cracking risk on the contact area relative to the constant of proportionality of the holding force exerted on the contact area, and can enhance the holding force with the increase of the contact area without largely affecting the breaking/cracking risk. Thus, the holding force can be further enhanced as the third ridge portions 15*g* and 15*b* and the fourth ridge portions 15*e* and 15*d* disposed closer to the inner end surfaces 9*a* and 9*b* have a smaller radius of curvature.

Particularly, the radius of curvature of the third ridge portions 15*g* and 15*b*, respectively disposed on the same side as the first ridge portions 15*h* and 15*a* that have a large radius of curvature and come into contact with the jig over a smaller contact area, is preferably smaller than the radius of curvature of the first ridge portions 15*h* and 15*a*. Thus, the third ridge portions 15*g* and 15*b* have a dimension in the axial direction smaller than the first ridge portions 15*h* and 15*a*. In this structure, the third ridge portions 15*g* and 15*b* have large contact areas over which they come into contact with the jig, and the reduction of the holding force exerted on the first ridge portions 15*h* and 15*a* can be prevented. Thus, the holding force can be enhanced without a large effect on the breaking/cracking risk.

In addition, the radii of curvature of the third ridge portions 15*g* and 15*b* and the fourth ridge portions 15*e* and 15*d* affect the areas of the flat portions of the bottom surfaces 5*b*, 5*c*, 6*b*, and 6*c* of the first and second flange portions 5 and 6. As the flat portions have larger areas, the wire coil component 1 is further stabilized on a mount substrate during being mounted thereon. Thus, the third ridge portions 15*g* and 15*b* and the fourth ridge portions 15*e* and 15*d* preferably have small radii of curvature.

In FIG. 4A, illustrating an example of the drum core 2*b*, the third ridge portions 15*g* and 15*b* and the fourth ridge portions 15*e* and 15*d* have dimensions in the axial direction shorter than those of the first ridge portions 15*h* and 15*a* and the second ridge portions 15*f* and 15*c*. More specifically, the first ridge portions 15*h* and 15*a*, the second ridge portions 15*f* and 15*c*, the third ridge portions 15*g* and 15*b*, and the fourth ridge portions 15*e* and 15*d* have curved shapes, and the third ridge portions 15*g* and 15*b* and the fourth ridge portions 15*e* and 15*d* respectively have radii of curvature smaller than the radii of curvature of the first ridge portions 15*h* and 15*a* and the second ridge portions 15*f* and 15*c*. Other components are the same as those of the second embodiment illustrated in FIG. 3.

In FIG. 4B, illustrating another example of the drum core 2*b*, the fourth ridge portions 15*e* and 15*d* have shorter dimensions in the axial direction than the first ridge portions 15*h* and 15*a* and the second ridge portions 15*f* and 15*c*. More specifically, the fourth ridge portions 15*e* and 15*d* have a radius of curvature smaller than the radii of curvature of the first ridge portions 15*h* and 15*a* and the second ridge portions 15*f* and 15*c*. Other components are the same as those of the second embodiment illustrated in FIG. 3.

In FIG. 4C, illustrating another example of the drum core 2*b*, the third ridge portions 15*g* and 15*b* have dimensions in the axial direction smaller than the first ridge portions 15*h* and 15*a* and the second ridge portions 15*f* and 15*c*. More specifically, the third ridge portions 15*g* and 15*b* have a radius of curvature smaller than the radii of curvature of the first ridge portions 15*h* and 15*a* and the second ridge portions 15*f* and 15*c*. Other components are the same as those of the second embodiment illustrated in FIG. 3.

As illustrated in FIGS. 4B and 4C, only either the third ridge portions 15*g* and 15*b* or the fourth ridge portions 15*e* and 15*d* may have smaller radii of curvature. As illustrated in FIG. 4C, the third ridge portions 15*g* and 15*b* and the fourth ridge portions 15*e* and 15*d* may be any radii of curvature smaller than those of the first ridge portions 15*h* and 15*a* and equivalent to those of the second ridge portions 15*f* and 15*c*. However, particularly preferably, both the third ridge portions 15*g* and 15*b* and the fourth ridge portions 15*e* and 15*d* have radii of curvature smaller than those of the first ridge portions 15*h* and 15*a* and the second ridge portions 15*f* and 15*c*.

As is clear from the above description, the first ridge portions 15*h* and 15*a*, the second ridge portions 15*f* and 15*c*, the third ridge portions 15*g* and 15*b*, and the fourth ridge portions 15*e* and 15*d* do not necessarily have to have curved shapes, and may have a planar shape extending straight to connect the side surfaces 8*a* to 8*d* to the outer end surfaces 7*a* and 7*b* or the inner end surfaces 9*a* and 9*b*. Here, the contact area with the corresponding jig can be determined with the dimension in the axial direction, instead of the radii of curvature. Thus, the first ridge portions 15*h* and 15*a*, the second ridge portions 15*f* and 15*c*, the third ridge portions 15*g* and 15*b* and, and the fourth ridge portions 15*e* and 15*d* may have dimensions in the axial direction satisfying the above relationship.

Particularly, the first ridge portions 15*h* and 15*a* having a planar shape can have a dimension in the axial direction larger than the second ridge portions 15*f* and 15*c* by being subjected to post processing such as cutting or grinding after forming a drum core. Thus, the first ridge portions 15*h* and 15*a* can be more easily formed.

Fourth Embodiment

Figure 5:
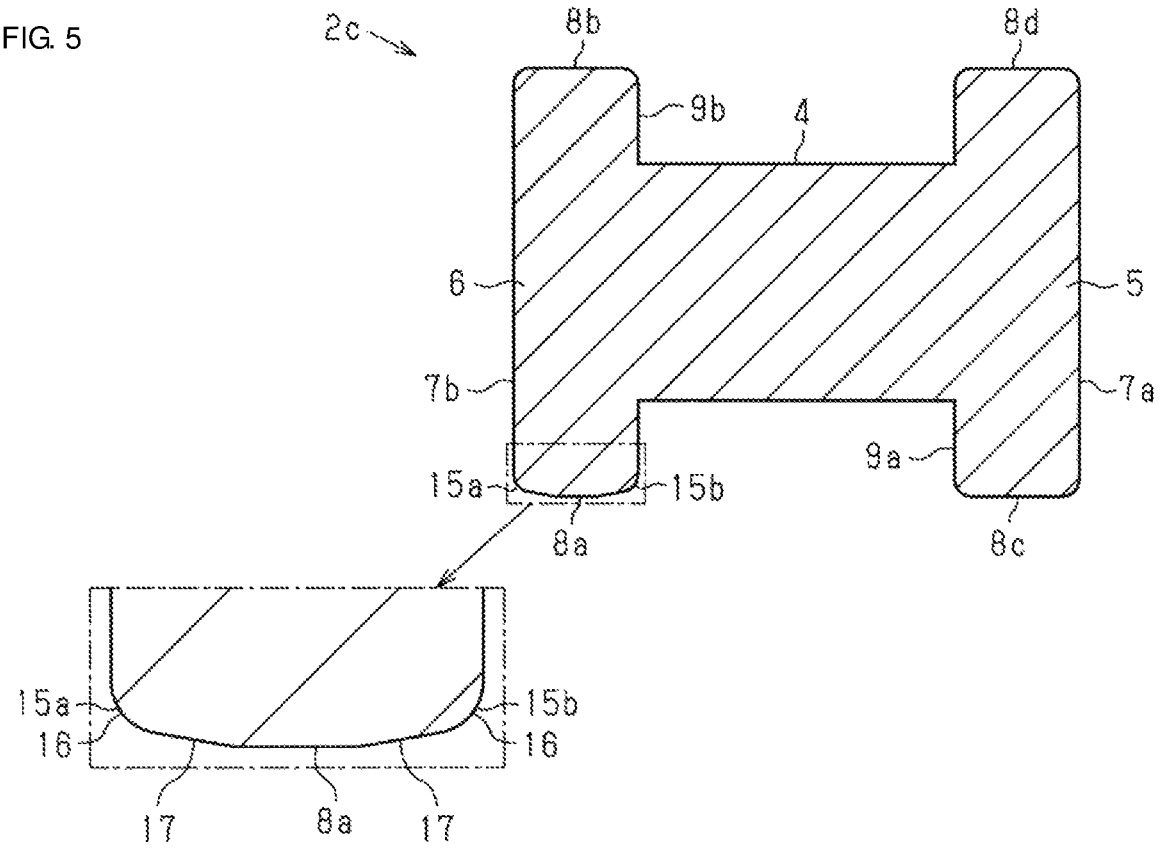
FIG. 5 is a cross-sectional view of a drum core according to a fourth embodiment.

FIG. 5 illustrates a fourth embodiment. In a drum core 2*c* according to this embodiment, the first ridge portion 15*a* and the third ridge portion 15*b* according to the first embodiment are formed with combinations each including a curved shape 16 and a planar shapes 17, continuous with the curved shape 16.

The above embodiments are mere examples, and all or some of the components of each embodiment may be flexibly combined with any component of another embodiment.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A drum core comprising:

a core portion that extends in an axial direction;

a first flange portion and a second flange portion respectively disposed at a first end and a second end of the core portion in the axial direction; and a first terminal electrode and a second terminal electrode respectively disposed at the first flange portion and the second flange portion, wherein the first flange portion includes a bottom surface that is substantially parallel to the axial direction and on which the first terminal electrode is disposed, an outer end surface that is substantially perpendicular to the axial direction and that faces outward away from the core portion, and a first ridge portion and a second ridge portion respectively disposed at a first end and a second end of the outer end surface in a width direction substantially parallel to the bottom surface and the outer end surface, and the first ridge portion and the second ridge portion have different shapes, and wherein the first ridge portion is at the first end of the outer end surface where the outer end surface meets the bottom surface, and the second ridge portion is at the second end of the outer end surface where the outer end surface meets the bottom surface.

2. The drum core according to claim 1, wherein the first ridge portion has a larger dimension in the axial direction than the second ridge portion.

3. The drum core according to claim 1, wherein the first ridge portion and the second ridge portion have curved shapes, and the first ridge portion has a radius of curvature larger than a radius of curvature of the second ridge portion.

4. The drum core according to claim 1, wherein the first flange portion further includes an inner end surface that is substantially perpendicular to the axial direction and faces the core portion, and a third ridge portion disposed at a first end of the inner end surface, on a same side as the first end of the outer end surface, and wherein the third ridge portion has a smaller dimension in the axial direction than the first ridge portion.

5. The drum core according to claim 4, wherein
the first ridge portion and the third ridge portion have curved shapes, and
the third ridge portion has a radius of curvature smaller than a radius of curvature of the first ridge portion.

6. The drum core according to claim 1, wherein
the first flange portion further includes
an inner end surface that is substantially perpendicular to the axial direction and faces the core portion, and
a third ridge portion and a fourth ridge portion respectively disposed at a first end and a second end of the inner end surface, the first end and the second end of the inner end surface are respectively on a same side as the first end and the second end of the outer end surface, and
wherein each of the third ridge portion and the fourth ridge portion has a smaller dimension in the axial direction than both of the first ridge portion and the second ridge portion.

7. The drum core according to claim 6, wherein
the first ridge portion, the second ridge portion, the third ridge portion, and the fourth ridge portion have curved shapes, and
each of the third ridge portion and the fourth ridge portion has a radius of curvature smaller than both of a radius of curvature of the first ridge portion and a radius of curvature of the second ridge portion.

8. The drum core according to claim 1, wherein
the first ridge portion has a planar shape.

9. The drum core according to claim 1, wherein
the first ridge portion includes, in combination, a curved shape continuous with a first end of the outer end surface and a planar shape continuous with the curved shape.

10. The drum core according to claim 1, wherein
when viewed in a direction substantially orthogonal to the bottom surface, the first flange portion and the second flange portion are centrally symmetric with respect to a center of the core portion.

11. The drum core according to claim 1, wherein
the first flange portion has a dimension in the axial direction of smaller than or equal to about 0.35 mm.

12. A wire coil component, comprising:
the drumm core according to claim 1; and
a plurality of wires wound around the core portion of the drum core.

13. The drum core according to claim 2, wherein
the first ridge portion and the second ridge portion have curved shapes, and
the first ridge portion has a radius of curvature larger than a radius of curvature of the second ridge portion.

14. The drum core according to claim 2, wherein
the first flange portion further includes
an inner end surface that is substantially perpendicular to the axial direction and faces the core portion, and
a third ridge portion disposed at a first end of the inner end surface, on a same side as the first end of the outer end surface, and
wherein the third ridge portion has a smaller dimension in the axial direction than the first ridge portion.

15. The drum core according to claim 2, wherein
the first flange portion further includes
an inner end surface that is substantially perpendicular to the axial direction and faces the core portion, and
a third ridge portion and a fourth ridge portion respectively disposed at a first end and a second end of the inner end surface, the first end and the second end of the inner end surface are respectively on a same side as the first end and the second end of the outer end surface, and
wherein each of the third ridge portion and the fourth ridge portion has a smaller dimension in the axial direction than both of the first ridge portion and the second ridge portion.

16. The drum core according to claim 2, wherein
the first ridge portion has a planar shape.

17. The drum core according to claim 2, wherein
the first ridge portion includes, in combination, a curved shape continuous with a first end of the outer end surface and a planar shape continuous with the curved shape.

18. The drum core according to claim 2, wherein
when viewed in a direction substantially orthogonal to the bottom surface, the first flange portion and the second flange portion are centrally symmetric with respect to a center of the core portion.

19. The drum core according to claim 2, wherein
the first flange portion has a dimension in the axial direction of smaller than or equal to about 0.35 mm.

20. A wire coil component, comprising:
the drum core according to claim 2; and
a plurality of wires wound around the core portion of the drum core.

* * * * *